US010122138B2

(12) United States Patent
Uyeda

(10) Patent No.: US 10,122,138 B2
(45) Date of Patent: Nov. 6, 2018

(54) ONE-PIECE CONNECTOR FOR LOCK ASSEMBLY AND METHOD OF SAME

(71) Applicant: Spectrum Brands, Inc., Middleton, WI (US)

(72) Inventor: Alan Uyeda, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/394,946

(22) Filed: Dec. 30, 2016

(65) Prior Publication Data

US 2017/0194758 A1 Jul. 6, 2017

Related U.S. Application Data

(60) Provisional application No. 62/274,927, filed on Jan. 5, 2016.

(51) Int. Cl.

| | |
|---|---|
| ***H01R 13/502*** | (2006.01) |
| ***H01R 27/02*** | (2006.01) |
| ***E05B 47/00*** | (2006.01) |
| ***H01R 9/24*** | (2006.01) |
| *E05B 49/00* | (2006.01) |

(52) U.S. Cl.

CPC ..... *H01R 27/02* (2013.01); *E05B 47/00* (2013.01); *E05B 47/0001* (2013.01); *H01R 9/2491* (2013.01); *E05B 49/00* (2013.01); *E05B 2047/0084* (2013.01)

(58) Field of Classification Search

CPC ..... H01R 13/514; H01R 13/518; H01R 17/12

USPC ..... 439/701, 608, 79

See application file for complete search history.

(56) References Cited

U.S. PATENT DOCUMENTS

| | | | | |
|---|---|---|---|---|
| 2003/0132829 | A1 | 7/2003 | Frolov et al. | |
| 2007/0111609 | A1* | 5/2007 | Sakamoto | H01R 13/62938 439/701 |
| 2010/0257906 | A1 | 10/2010 | Sorensen et al. | |
| 2011/0252843 | A1 | 10/2011 | Sumcad et al. | |
| 2014/0250956 | A1 | 9/2014 | Chong | |
| 2014/0260929 | A1 | 9/2014 | Leites et al. | |

OTHER PUBLICATIONS

Spectrum Brands, Inc.; 2nd Generation Installation and User Guide; Kevo Touch to Open Smart Lock; www.kwikset.com/kevo/support; 2016.

Black & Decker Corporation; Smart Code Installation & Programming Manual; http://s7d5.scene7.com/is/content/BDHHI/Website%20Content/Kwikset/Resources/KwiksetSmartCodeManual.pdf; 2008.

International Search Report and Written Opinion; PCT/US2017/012151; One-Piece Connector for Lock Assembly and Method of Same; dated Mar. 20, 2017.

* cited by examiner

*Primary Examiner* — Phuong Chi T Nguyen

(74) *Attorney, Agent, or Firm* — Merchant & Gould P.C.

(57) ABSTRACT

A unitary connector assembly for a lock assembly and method of using same. The connector assembly includes at least two types of connectors. One connector would be configured for a first type of wiring and the second connector would be configured for a second type of wiring. The connector assembly includes a shell having at least one cavity. The first type of connector and second type of connector are both at least partially positioned within the cavity.

19 Claims, 5 Drawing Sheets

ONE-PIECE CONNECTOR FOR LOCK ASSEMBLY AND METHOD OF SAME

RELATED APPLICATIONS

This application claims the benefit of U.S. Provisional Application Ser. No. 62/274,927 filed Jan. 5, 2016, for a "One-Piece Connector for Lock Assembly and Method of Same," which is hereby incorporated by reference in its entirety.

TECHNICAL FIELD

This disclosure relates generally to electro-mechanical locks, and more particularly, to a connector assembly for such electro-mechanical locks.

BACKGROUND

Electro-mechanical locks are generally configured to include (i) an interior assembly configured to be received within an access panel, the interior assembly including electrical components and components for other functionalities of the lock and (ii) an exterior assembly that a user interacts with in order to operate the locking functionality of the lock or control the components within the interior assembly. During installation of a lock, electronic cables or wires from the exterior assembly must be connected to the interior assembly to permit control over the interior assembly components. This connection process can often be a source of frustration for consumers and further requires excess wiring that must be "tucked" into a cavity or space within the lock assembly during installation.

Further, electro-mechanical locks are generally configured to permit operation of a lock assembly through either mechanical operation (e.g. a key) or via electronic operation. Electro-mechanical locks may be configured to permit electronic operation of a lock assembly either (i) manually-initiated by a physical action of a user (e.g. inputting a code into an electronic key pad) that is transmitted to the interior assembly or (ii) automatically via blue-tooth or antenna technology that utilizes an authentication signal transmitted from a user's personal device within a predetermined distance of the lock assembly. However, such antenna technology often requires a communication path (e.g. wiring) to the interior assembly that is different or separate from other electrical wiring for the electro-mechanical lock. Accordingly, there may be multiple types of wiring from the exterior assembly to the interior assembly of the lock assembly when antenna technology is provided to permit operation of the lock assembly. This may provide greater confusion or frustration for a consumer during installation of the lock assembly.

Therefore, there is a need for a single-piece connector that can house two or more electronic connectors for two or more different/separate communication paths. The connector may be configured as part of the exterior assembly to be directly connectable to the interior assembly during installation (or vice versa) to reduce or eliminate confusion with multiple wiring connections and the need for placement/storage of excess wiring. The connector may be enabled with a rotatable pull tab to assist with removal of the connector from the interior assembly that can rotate out of the way when not in use.

BRIEF DESCRIPTION OF THE DRAWINGS

The present disclosure will be described hereafter with reference to the attached drawings which are given as non-limiting examples only, in which.

DETAILED DESCRIPTION OF THE DRAWINGS

Figure 1:
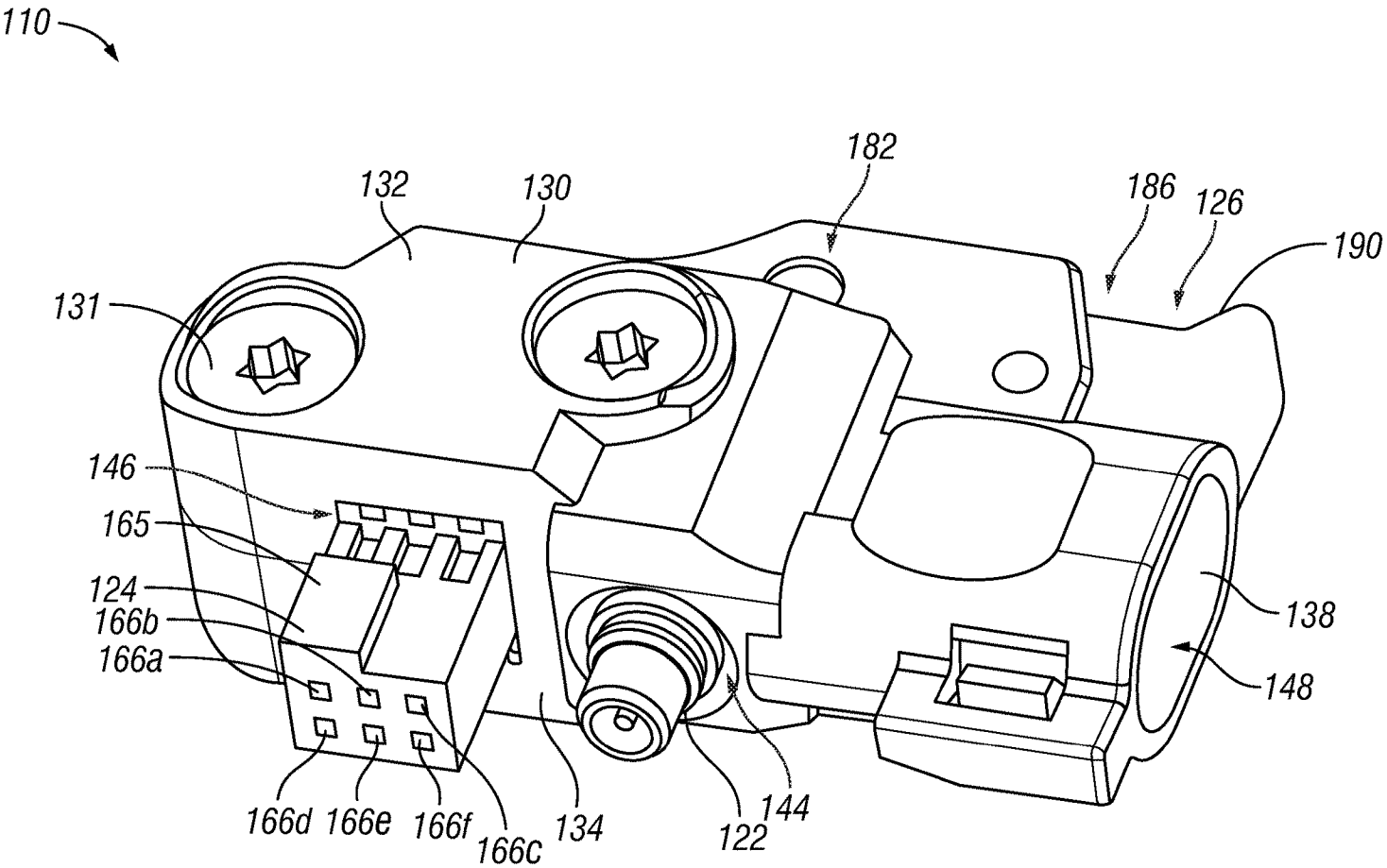
FIG. 1 is a bottom perspective view of an example connector assembly for a lock assembly according to one embodiment of the disclosure.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

This disclosure generally relates to an electromechanical lock with certain features. The term "electronic lock" is broadly intended to include any type of lockset that uses electrical power in some manner, including but not limited to electronic deadbolts, electronic lever sets, etc. This disclosure encompasses the integration of one or more of the features described herein into any type of electronic lock and is not intended to be limited to any particular type of electronic lock.

Figure 2:
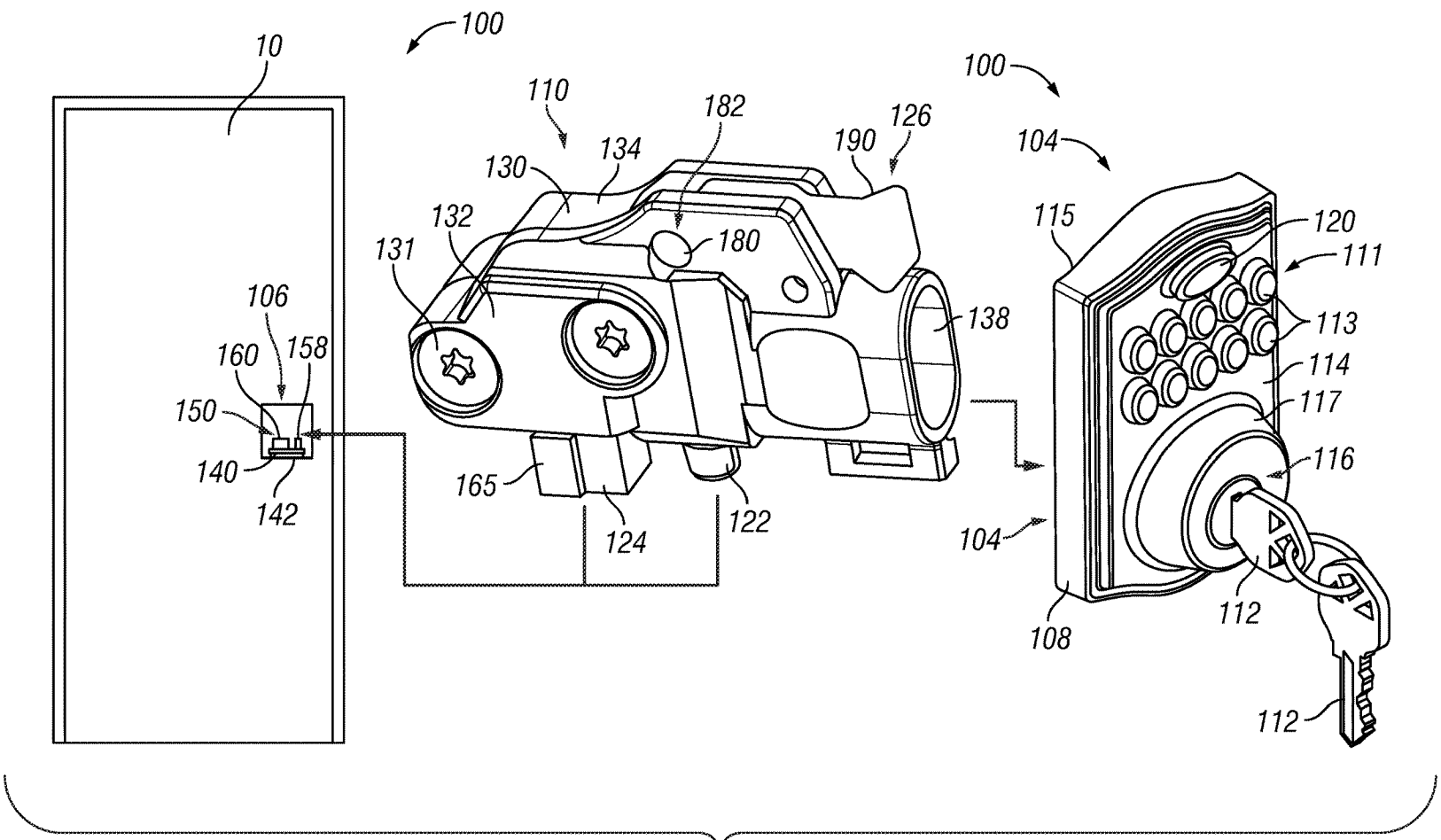
FIG. 2 is a diagrammatical representation showing an example lock assembly with a connector assembly according to the embodiment shown in FIG. 1, the connector assembly is configured to connect an exterior assembly of the lock assembly with an interior assembly of the lock assembly mounted inside a door.

FIG. 1 shows a connector assembly 110 for a lock assembly 100 according to one embodiment of the disclosure. The connector assembly 110 is configured to connect electrical elements of one or more components of the lock assembly 100 in order for the lock assembly 100 to be electronically controllable from an exterior of the lock assembly 100, as illustrated in FIG. 2. Specifically, as described herein, the connector assembly 110 includes at least a first type of connector 122 and a second type of connector 124 that permits at least two separate electrical connections within the lock assembly 100. In various embodiments, the connector assembly 110 is configured to be part of an exterior assembly 102 of the lock assembly 100, where the exterior assembly 102 permits a user to control operation of an interior assembly 106 in order to unlock the lock assembly 100 while the user is outside of the space being secured by the lock assembly 100. The connector assembly 110 may then be manually connected to an interior connector assembly 150 of the interior assembly 106 as described herein in order to form electrical connections between the exterior assembly 102 and the interior assembly 106.

FIG. 2 illustrates that an exemplary embodiment of the lock assembly 100 includes at least the connector assembly 110, the exterior assembly 102, and the interior assembly 106. Typically, the exterior assembly 102 is configured to be mounted on the outside of a door or other access panel 10, while the interior assembly 106 is configured to be mounted inside or within the door or access panel 10 (or within a cavity formed in the door 10). In various embodiments, the connector assembly 110 may be fixedly attached to the exterior assembly 102. In illustrative embodiments, there may be a latch assembly (not shown) as part of the interior assembly 106 and mounted in a bore formed in the door 10 that is controllable by the lock assembly 100, such that the latch assembly may prevent or permit the door 10 to become unlatched to permit access. The term "outside" is used broadly to mean an area outside of a door, and "inside" is used broadly to denote an area inside the structure of the door. In various embodiments, the latch assembly may be in the form of a deadbolt, or may be in the form of any other type of latch for an electromechanical lock. An exemplary embodiment of an electromechanical lock is described in U.S. Pat. No. 9,024,759, the disclosure of which is fully incorporated by reference herein. The lock assembly 100 described herein is applicable to both interior and exterior doors.

In illustrative embodiments, the exterior assembly 102 includes a guard cover 108 that houses internal components of the exterior assembly 102, a back cover 115, and a front cover 114. The guard cover 108 may be formed of any decorative or utilitarian shape desired and depending on the particular circumstances. The front cover 114 is configured to span between the guard cover 108 to generally prevent access to an interior portion of the exterior assembly 102. The connector assembly 110 may be at least partially retained within a cavity 104 formed between a portion of the guard cover 108 and the front cover 114, wherein the cavity 104 is accessible from the back cover 115 of the exterior assembly 102 that is opposite the front cover 114. The back cover 115 is configured to abut against the door 10 when the exterior assembly 102 is connected to the interior assembly 106, thereby preventing access to the cavity 104 and the connector assembly 110 when the lock assembly 100 is fully constructed.

The exterior assembly 102 may further include a mechanical locking assembly 116 and/or an electronic locking assembly 118 that each can permit operation of the latch assembly in order to operate the lock assembly 100. The mechanical locking assembly 116 may be in communication with the latch assembly of the interior assembly 106, and may be configured to receive a mechanical lock key 112 that is insertable into the mechanical locking assembly 116 to mechanically unlock the lock assembly 100 by rotation of the key 112, as is known in the industry. The mechanical locking assembly 116 may be housed in a mechanical lock housing 117 that extends through the front cover 114.

Alternatively, the electronic locking assembly 118 may be in communication with the latch assembly of the interior assembly 106 to control operation of the latch assembly. The electronic locking assembly 118 may be operated through multiple methods. For instance, the electronic locking assembly 118 may include a sensor 120 that can receive an electronic signal or authentication code transmitted by a user within range of the exterior assembly 102 to cause a motor (not shown) within the lock assembly 100 to control the latch assembly. Although a sensor 120 is shown for purposes of example, other digital or electronic input devices could be used, including but not limited to a touch screen, biometric sensor, antenna or GPS sensor, magnetic sensor, or the like. The electronic locking assembly 118 may further include a keypad 111 with a plurality of buttons 113 that extend through the front cover 114 and that may be used to manually enter a passcode for unlocking the lock assembly 100 via the motor. Accordingly, in the embodiment shown, the exterior assembly 102 may be used to lock/unlock a deadbolt assembly (or other locking mechanism) either mechanically with the mechanical key 112 or electronically via a signal or code transmitted or entered by a user via the sensor 120 or keypad 111.

In various embodiments, the sensor 120 of the exterior assembly 102 is configured to detect transmission of a signal from a user's personal electronic device (e.g. smartphone, tablet, etc.) when the user's personal device is located within a predetermined distance range from the sensor 120 (e.g. a personal-area network or piconet). For example, a user may have an application on their device which automatically transmits a signal that identifies/authenticates the user, and that signal may be picked up by the sensor 120 if the user's device is within a certain distance of the sensor 120. Alternatively, a user may be able to send a signal from their device to the sensor 120 when the user is within the predetermined range. When the sensor 120 receives an authenticated signal from a user, the lock assembly 100 may be programmed to lock or unlock the latch assembly in response to the signal, thereby permitting or prohibiting opening of the door 10.

In various embodiments, the sensor 120 may be an antenna, a blue-tooth device, a GPS device, or the like. As is known in the art, use of such sensors typically requires special components within the electrical communication links (e.g. wires) that supply power and support to the sensor, or the communication links may be required to have certain unique characteristics or treatment from other electrical components. For instance, while multiple electrical wires associated with the keypad 111 or a visual display on the exterior assembly 102 may be bound together in a single bundle of wires, it may be unsuitable to bundle the wiring for an antenna or blue-tooth device with these other wires in light of the unique connection and wiring requirements of antenna/blue-tooth technology. Accordingly, multiple connection points (e.g. one for antenna/blue-tooth wiring and one for other electrical wiring) may be required in a lock assembly 100 that includes alternative forms of operation within the electronic locking assembly 118.

Figure 3:
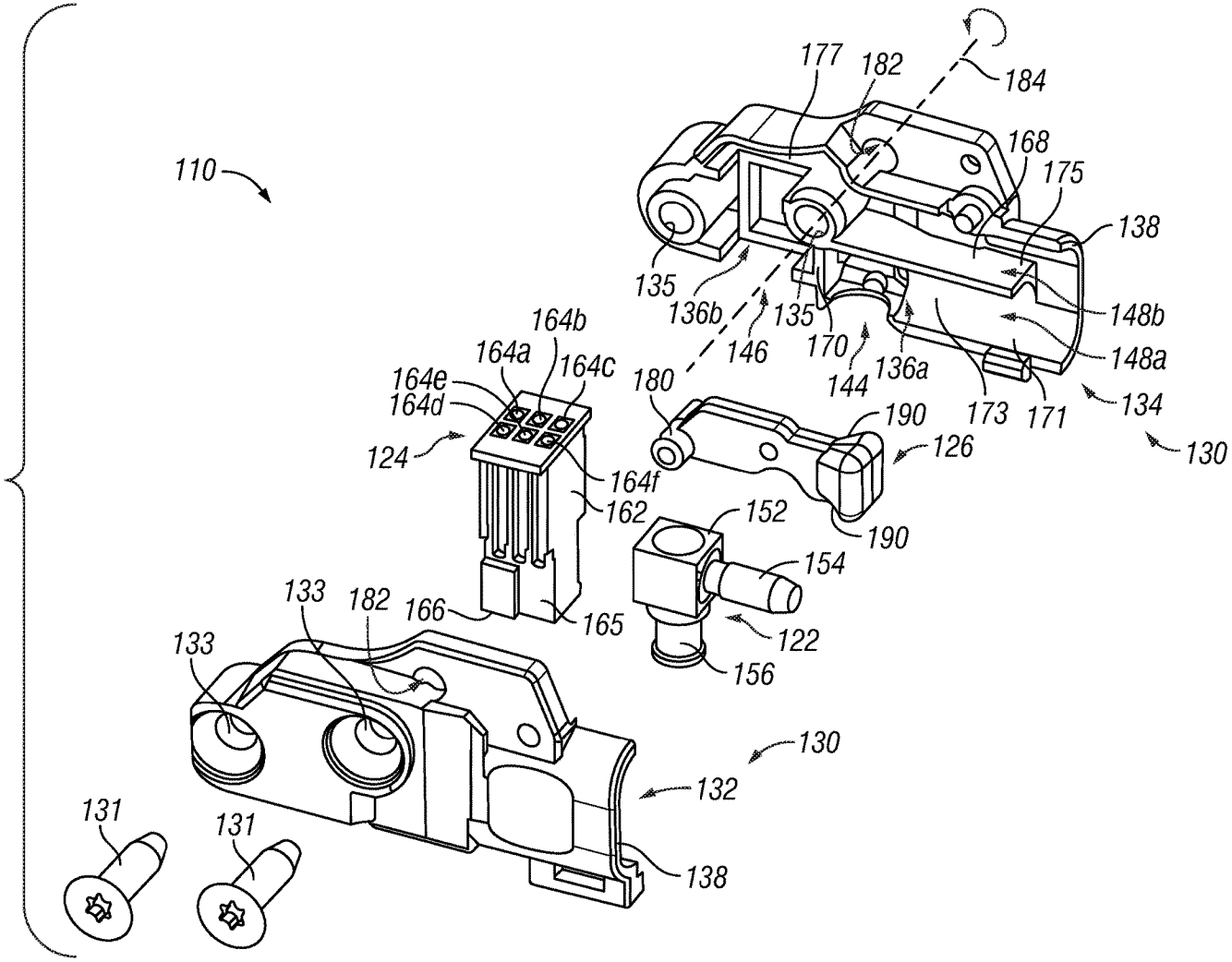
FIG. 3 is an exploded view of the connector assembly according to the embodiment shown in FIG. 1.
Figure 4:
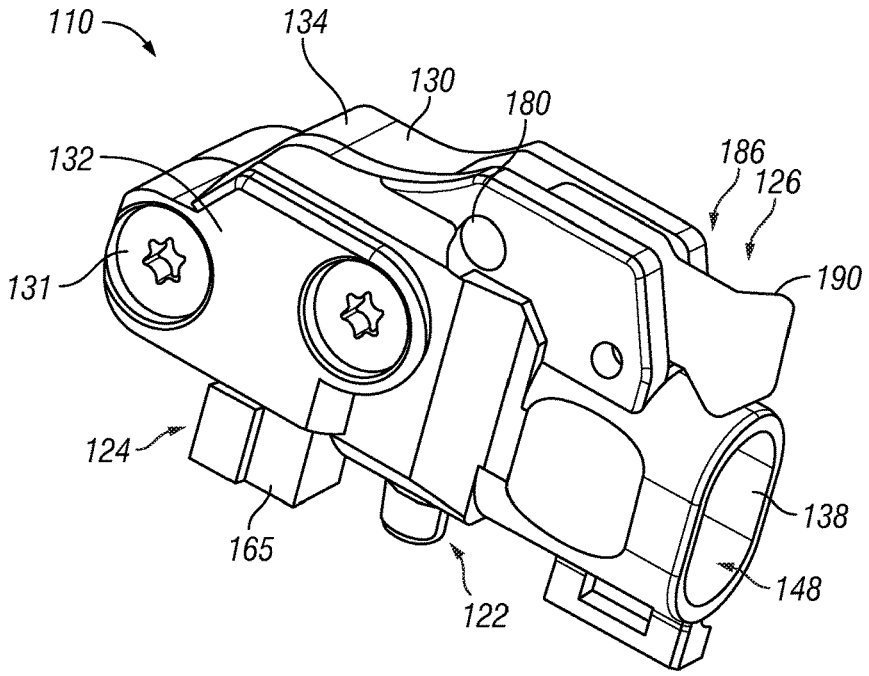
FIG. 4 is a first side perspective view of the connector assembly according to the embodiment shown in FIG. 1.
Figure 5:
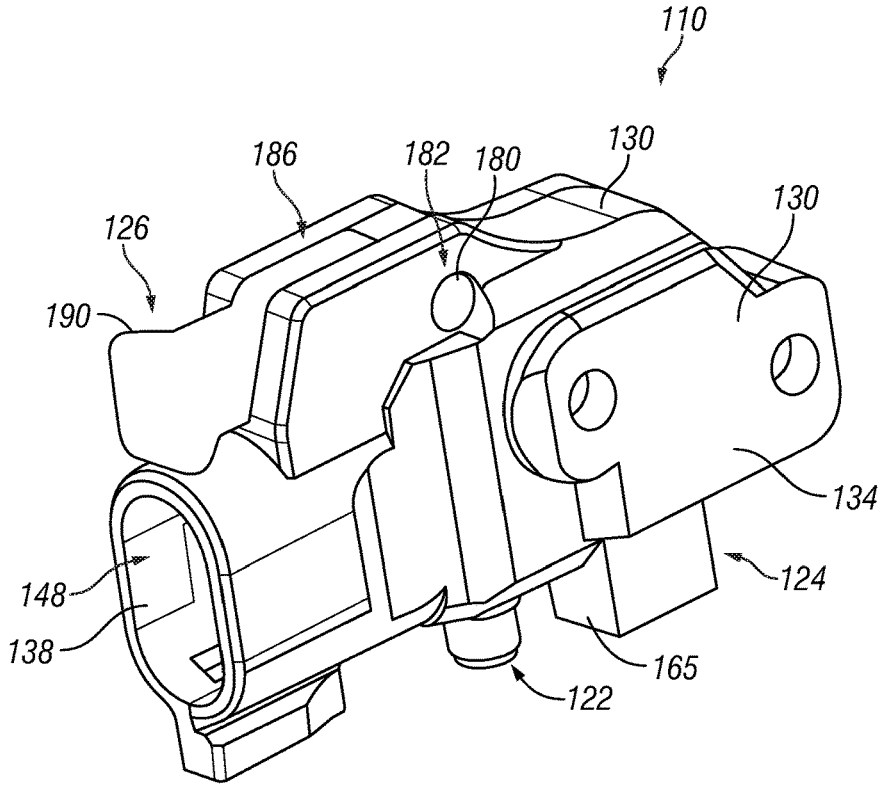
FIG. 5 is a second side perspective view of the connector assembly according to the embodiment shown in FIG. 1.

As illustrated in FIGS. 3-5, the connector assembly 110 comprises a shell 130, the first connector 122, the second connector 124, and an optional rotating pull tab 126. The shell 130 may be comprised of a first panel 132 and a second panel 134 that are configured to be coupled together to form at least one cavity 136 therebetween. In illustrative embodiments, the cavity 136 is configured to receive at least a portion of the first connector 122 and at least a portion of the second connector 124. The first panel 132 and second panel 134 may be fixedly secured together via any known means, including for example, a pair of set screws 131 that extend through set screw holes 133 in the first panel 132 and are secured within screw plugs 135 in the second panel, as illustrated in FIG. 3. In various embodiments, the shell 130 of the connector assembly 110 and at least portions of the first and second connectors 122 and 124 may be formed from plastic or other suitable material.

The shell 130 is formed to include a wiring-receiving aperture 138, a first connector aperture 144 and a second connector aperture 146, as illustrated in FIGS. 1 and 3. In various embodiments, the wiring-receiving aperture 138 is formed to receive communication wiring from multiple connection points (e.g. antenna/blue-tooth wiring and other electrical wiring). For instance, antenna/blue-tooth wiring from the sensor 120 and other electrical wiring from the keypad 111 may extend through the wiring-receiving aperture 138.

The shell 130 may further comprise one or more channels 148 that extend from the wiring-receiving aperture 138 to the cavity 136 to permit the wiring to be connected to the first and second connectors 122 and 124, as illustrated in FIG. 3. In various embodiments, the one or more channels may be divided by a channel partition 168. For instance, a first channel 148*a* may be configured to receive antenna/blue-tooth wiring that extends through the wiring-receiving aperture 138, and a second channel 148*b* may be configured to receive other electrical wiring that extends through the wiring-receiving aperture 138. Other means of providing separation between antenna/blue-tooth wiring and other electrical wiring are envisioned herein. Alternatively, antenna/blue-tooth wiring and other electrical wiring may be positioned within a single channel 148.

In illustrative embodiments, the antenna/blue-tooth wiring is coupled to the first connector 122 within the cavity 136 of the connector assembly 110, and other electrical wiring is coupled to the second connector 124 within the cavity 136 of the connector assembly 110. In illustrative embodiments, a connector partition 170 may extend within the cavity 136 between the first and second connectors 122 and 124 to create a first cavity 136*a* containing the first connector 122 and a second cavity 136*b* containing the second connector 124. In such embodiments, the first channel 148*a*, containing antenna/blue-tooth wiring, may extend from a first end 171 adjacent the wiring-receiving aperture 138 to a second end 173 that is adjacent the first cavity 136*a* housing the first connector 122. Similarly, the second channel 148*b*, containing other electrical wiring, may extend from a first end 175 adjacent the wiring-receiving aperture 138 to a second end 177 that is adjacent to the second cavity 136*b* housing the second connector 124. Accordingly, the antenna/blue-tooth wiring and the other electrical wiring may be substantially separated from each other within the connector assembly 110.

The first connector 122 is configured to provide electrical connection between the antenna/blue-tooth wiring of the exterior assembly 102 and an interior connection assembly 150 of the interior assembly 106. As illustrated in FIG. 3, the first connector 122 includes a body 152, a receiving port 154, and a transmission port 156. The antenna wiring extends through the wiring-receiving aperture 138 and is coupled to the receiving port 154. The receiving port 154 and the transmission port 156 are electrically coupled together within the body 152 to permit electrical communication from the receiving port 154 to the transmission port 156 and vice versa. The transmission port 156 is configured to be coupled with a first receiving dock 158 of the interior connection assembly 150, as discussed herein. The first connector aperture 144 of the shell 130 of the connector assembly 110 is configured to receive the transmission port 156 and permits the transmission port 156 to extend therethrough. In various embodiments, the first connector 122 may be L-shaped such that the receiving port 154 and the transmission port 156 are positioned at a right angle to each other.

The second connector 124 is configured to provide an electrical connection between the other electrical wiring of the exterior assembly 102 and an interior connection assembly 150 of the interior assembly 106. As illustrated in FIGS. 1 and 3, the second connector 124 includes a body 162, one or more receiving ports 164, and one or more transmission ports 166. The electrical wiring extends through the wiring-receiving aperture 138 and is coupled to the receiving ports 164. The receiving ports 164 and the transmission ports 166 are electrically coupled together within the body 162 to permit electrical communication from the receiving ports 164 to the transmission ports 166 and vice versa. As an illustrative example, there may be six (6) receiving ports 164*a*, 164*b*, 164*c*, 164*d*, 164*e*, and 164*f* that are each separately coupled to six (6) transmissions ports 166*a*, 166*b*, 166*c*, 166*d*, 166*e*, and 166*f*. The transmission ports 166 are configured to be coupled with a second receiving dock 160 of the interior connection assembly 150, as discussed herein. The second connector aperture 146 of the connector assembly 110 is configured to receive a port portion 165 of the body 162 that surrounds the transmission ports 166, permitting the port portion 165 including the transmission ports 166 to extend therethrough. In various embodiments, the receiving ports 164 and the transmission ports 166 may be linearly positioned with respect to each other within the second connector 124.

In illustrative embodiments, the connector assembly 110 may be configured to retain more than two connectors if three or more separate communication paths are necessary or desirable. For instance, the scope of the present disclosure envisions a connector assembly 110 that may permit three separate communication paths for three separate functionalities of the lock assembly 100. Other amounts of separate communication paths within the connector assembly 110 are envisioned herein.

Figure 6:
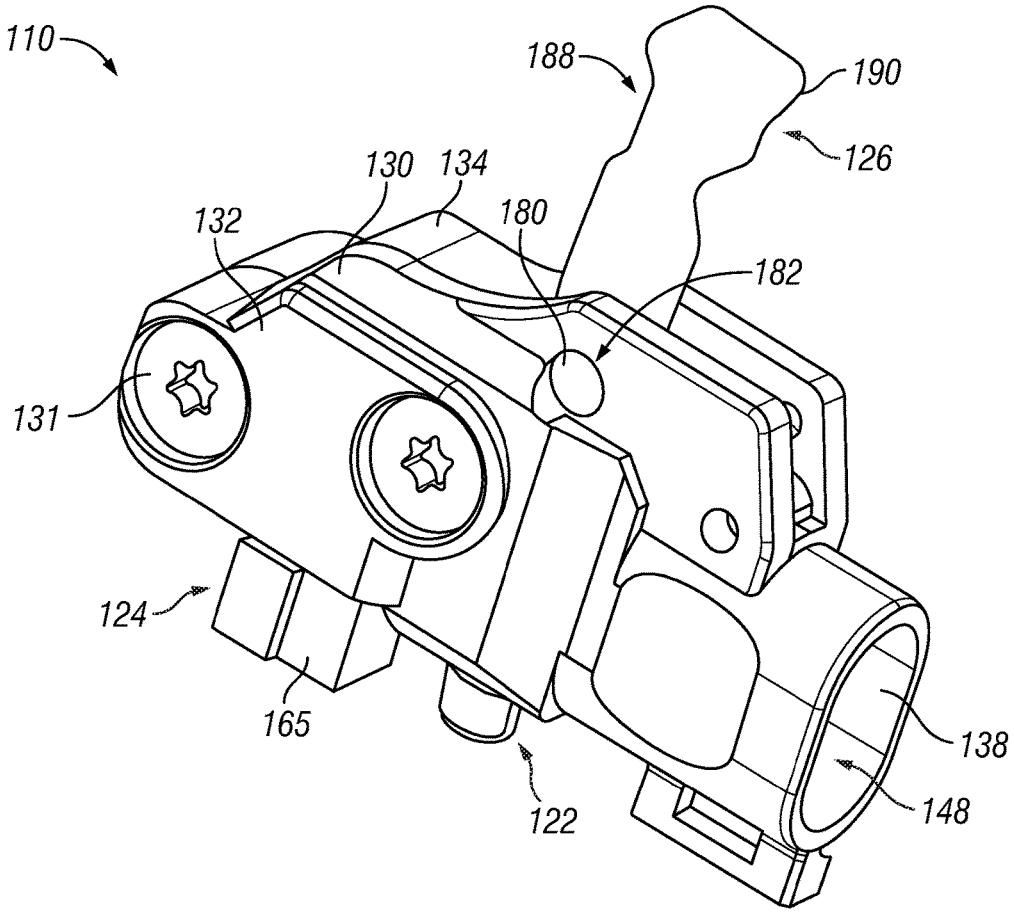
FIG. 6 is a side perspective view of the connector assembly according to the embodiment shown in FIG. 1 and illustrating the connector assembly includes a rotatable pull tab.

The connector assembly 110 may further include the optional pull tab 126 that is sized and configured to rotate with respect to the shell 130 to provide a location for a user to grab or hold when disassembling the connector assembly 110 from the interior assembly 106. As illustrated in FIGS. 3-6, the pull tab 126 may include a pivot cam 180 that is configured to be received within pivot apertures 182 in the shell 130 to rotate the pull tab 126 about a pivot axis 184. The pull tab 126 may rotate from a first position 186 where the pull tab 126 is substantially in parallel alignment with the shell 130, as illustrated in FIG. 4, to a second position 188 where the pull tab 126 is substantially perpendicular to the shell 130, as illustrated in FIG. 6. When the pull tab 126 is rotated to the second position 188, a pulling ledge 190 of the pull tab 126 is accessible for a user to apply a pulling force with their fingers in order to dislodge the connector assembly 110 from its engagement with the interior assembly 106. When the pull tab 126 is not being used to disconnect the connector assembly 110 from the interior assembly 106, it may be rotated back to the first position 186 to be stored against the shell 130 such that it is substantially out of the way of other components within the exterior assembly 102.

In illustrative embodiments, the interior assembly 106 is configured to be connected and coupled to the exterior assembly 102 via at least the connector assembly 110. The interior assembly 106 houses one or more internal components of the internal assembly 106. In various embodiments, the internal components may include a turnpiece (not shown) that can actuate the latch assembly to extend and retract a bolt within the locking assembly 100. In various embodiments, the interior assembly 106 includes a torque blade (not shown). As known in the industry, the torque blade may be configured to rotate within the interior assembly 106 in a first direction to cause the bolt to extend, and which is further configured to rotate in an opposite direction to cause the bolt to retract. For example, the torque blade may be manually rotated using the mechanical lock assembly 116, or electronically controlled with the motor that is responsive to a user transmitting an authorization signal or entering a passcode via the electronic locking assembly 118, in order to extend or retract the bolt.

In various embodiments, the interior assembly 106 further includes at least a PCB main board 140 or other similar controlling device. The PCB main board 140 may be a circuit board that has a controller or processor (not shown) that is programmed for one or more of the functions described herein. In an illustrative example, the main board 140 includes at least an electrical input dock 160 that is configured to be in electrical communication with the interior connector assembly 150 to receive communication from the connector assembly 110. For instance, the main board 140 may receive at least communication from the second connectors 124 that connects to the other electrical wiring from the exterior assembly 102. In various embodiments, the PCB board 140 may further be connected to a daughter board 142 that includes an antenna (not shown), such as a Zigbee antenna, and/or a receiver for transmitting or receiving radio frequency signals to and from other electronic devices.

In various embodiments, the interior assembly 106 further includes an antenna/blue-tooth input dock 158 that is configured to be in electrical communication with the first connector 122 of the connector assembly 102 that connects to the antenna/blue-tooth wiring from the exterior assembly 102. The antenna/blue-tooth input dock 158 may be integral to the main board 140, or may be part of a separate board or controller (not shown) within the interior assembly 106. Other forms of connecting the first connector 122 to suitable technology are envisioned herein.

In operation, the exterior assembly 102 is electronically and structurally coupled to the interior assembly 106 to form the lock assembly 100 to prevent access to an interior or inside space of a door or access panel 10. The exterior assembly 102 may then be used to control operation of the lock assembly 100 through multiple methods, such that the lock assembly 100 may be unlocked or other functions of the lock assembly 100 performed.

The first method of operating the lock assembly 100 may be automatically through blue-tooth or antenna technology that detects an authenticated user's presence. When the interior and exterior assemblies 102 and 106 are assembled together, the sensor 120 of the exterior assembly 102 is configured to receive a signal transmitted from a user's device within a predetermined range of the sensor 120. The sensor 120 then communicates with the main board 140 within the interior assembly 106 via the connector assembly 110 (and in particular the first connector 122) to confirm that the signal received is authenticated to a user who is permitted to control operation of the lock assembly 100. Once the signal has been authenticated, the main board 140 may then automatically unlock the lock assembly 100, and may optionally send a return signal back to the sensor 120 to cause the sensor 120 (or other component of the exterior assembly 102) to indicate that authentication occurred (e.g. the sensor 120 provides a light or sound to the user).

Alternatively, a second way of operating the lock assembly 100 may be through manual entering of a passcode on the keypad 111. When the interior and exterior assemblies 102 and 106 are assembled together, the keypad 111 of the exterior assembly 102 is configured to receive passcode input from user via, for example, buttons 113. The keypad 111 then communicates with the main board 140 within the interior assembly 106 via the connector assembly 110 (and in particular the second connector 124) to confirm that the passcode received is authenticated to control operation of the lock assembly 100. Once the passcode has been authenticated, the main board 140 may then automatically unlock the lock assembly 100, and may optionally send a return signal back to the keypad 111 or exterior assembly 102 to indicate that authentication occurred (e.g. the keypad 111 provides a light or sound to the user).

A third way of operating the lock assembly 100 is through manual operation of the mechanical locking assembly 116 via the mechanical lock key 112, as is known in the art.

EXAMPLES

Illustrative examples of the connector assembly of the lock assembly disclosed herein are provided below. An embodiment of the connector assembly, or the lock assembly that includes the connector assembly, may include any one or more, and any combination of, the examples described below.

Example 1 is a unitary connector assembly for a lock assembly. The connector assembly is comprised of a first type of connector with a first end and a second end. The first end is coupled to a first type of wiring, such as associated with an antenna or blue-tooth sensor, and the second end includes a transmission port to transmit information from the first type of wiring. A second type of connector has a first end and a second end. The first end is coupled to a second type of wiring and the second end includes a transmission port to transmit information from the second type of wiring and a shell having at least one cavity wherein the first type of connector is at least partially positioned within the cavity and the second type of connector is at least partially positioned within the cavity.

In Example 2, the subject matter of Example 1 is further configured with a shell that includes an aperture to receive the first type of wiring and the second type of wiring.

In Example 3, the subject matter of Example 1 is further configured such that the first type of connector is separated from the second type of connector by a partition within the cavity.

In Example 4, the subject matter of Example 3 is further configured such that the shell includes a first channel adjacent the first end of the first type of connector and a second channel adjacent the first end of the second type of connector.

In Example 5, the subject matter of Example 4 is further configured such that the first type of wiring is positioned within the first channel and the second type of wiring is positioned within the second channel such that the first type of wiring is separate from the second type of wiring within the channels.

In Example 6, the subject matter of Example 1 is configured such that the first type of wiring is coupled to a receiving port at the first end of the first type of connector, and the receiving port is positioned perpendicular to the transmission port.

In Example 7, the subject matter of Example 1 is configured such that the second type of wiring is a bundle of two or more electrical wires.

In Example 8, the subject matter of Example 7 is configured such that the first end of the second type of connector includes separate receiving ports that each receives an individual wire.

In Example 9, the subject matter of Example 9 is further configured such that the first end of the second type of connector includes six separate receiving ports.

In Example 10, the subject matter of Example 8 is configured such that the second end of the second type of connector includes multiple transmission ports that correspond to each receiving port.

In Example 11, the subject matter of Example 1 is further configured such that the shell includes a rotating pull tab.

In Example 12, the subject matter of Example 11 is configured such that the rotating pull tab pivots from a position generally parallel to the shell to a position generally perpendicular to the shell.

Example 13 is an electronic lock assembly comprised of an interior assembly including a circuit board and a latch assembly. The circuit board is configured to control operation of the latch assembly. An exterior assembly includes an electronic locking assembly and the electronic locking assembly is configured to permit a user to control the latch assembly. The exterior assembly further includes a first type of electrical wiring and a second type of electrical wiring. A unitary connector assembly is configured to connect both the first type of electrical wiring and the second type of electrical wiring with the interior assembly. The connector assembly is comprised of a first type of connector. It includes a receiving port to receive the first type of electrical wiring and a transmission port to transmit information received from the first type of electrical wiring. It also includes a second type of connector which includes a receiving port to receive the second type of electrical wiring and a transmission port to transmit information received from the second type of electrical wiring. It also includes a shell having at least one cavity. The first type of connector is positioned substantially within this cavity. The second type of connector is positioned substantially within the cavity as well.

In Example 14, the subject matter of Example 13 is configured such that the transmission port of the first type of connector assembly is received by a first receiving dock of the interior assembly and the transmission port of the second type of connector assembly is received by a second receiving dock of the interior assembly.

In Example 15, the subject matter of Example 14 is further configured such that the first receiving dock and the second receiving dock are coupled to the circuit board.

In Example 16, the subject matter of Example 13 is configured with a second type of connector that includes two or more receiving ports and two or more transmission ports.

In Example 17, the subject matter of Example 16 is configured such that the two or more transmission ports are received by a first receiving dock of the interior assembly. The first receiving dock includes two or more docking inlets that correspond with each transmission port.

In Example 18, the subject matter of Example 13 is further configured such that the shell of the connector assembly includes a rotatable pull tab to permit the connector assembly to be disconnected from the interior assembly.

In Example 19, the subject matter of Example 13 is further configured such that the connector assembly is positioned within a cavity of the exterior assembly.

Example 20 is a method of forming an electronic lock assembly. The method is comprised of a provided interior assembly that includes a circuit board and a latch assembly. The circuit board is configured to control the operation of the latch assembly and provides an exterior assembly that includes a first type of electrical wiring and a second type of electrical wiring, a unitary connector assembly comprising a first type of connector associated with the first type of electrical wiring, and a second type of connector associated with the second type of electrical wiring. The first type of connector and the second type of connector are positioned within a shell of the unitary connector and extend partially through one or more apertures of the shell. This connects the first type of electrical wiring and the second type of electrical wiring of the exterior assembly with the circuit board of the interior assembly by connecting the unitary connector assembly with an interior connector assembly of the interior assembly.

Although certain embodiments have been described and illustrated in exemplar forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

The invention claimed is:

1. A unitary connector assembly for a lock assembly, the connector assembly comprising:

a first type of connector with a first end and a second end, the first end coupled to a first type of wiring and the second end including a transmission port to transmit information from the first type of wiring;

a second type of connector with a first end and a second end, the first end coupled to a second type of wiring and the second end including a transmission port to transmit information from the second type of wiring; and a shell having at least one cavity, wherein the first type of connector is at least partially positioned within the cavity and the second type of connector is at least partially positioned within the cavity, wherein the shell includes a rotating pull tab.

2. The connector assembly of claim 1, wherein the shell includes an aperture to receive the first type of wiring and the second type of wiring.

3. The connector assembly of claim 1, wherein the first type of wiring is coupled to a receiving port at the first end of the first type of connector, and wherein the receiving port is positioned perpendicular to the transmission port.

4. The connector assembly of claim 1, wherein the rotating pull tab pivots from a position generally parallel to the shell to a position generally perpendicular to the shell.

5. The connector assembly of claim 1, wherein the first type of connector is separated from the second type of connector by a partition within the cavity.

6. The connector assembly of claim 5, wherein the shell further includes a first channel adjacent the first end of the first type of connector and a second channel adjacent the first end of the second type of connector.

7. The connector assembly of claim 6, wherein the first type of wiring is positioned within the first channel and the second type of wiring is positioned within the second channel such that the first type of wiring is separate from the second type of wiring within the channels.

8. The connector assembly of claim 1, wherein the second type of wiring is a bundle of two or more electrical wires.

9. The connector assembly of claim 8, wherein the first end of the second type of connector includes separate receiving ports that each receives an individual wire.

10. The connector assembly of claim 9, wherein the first end of the second type of connector includes six separate receiving ports.

11. The connector assembly of claim 9, wherein the second end of the second type of connector includes multiple transmission ports that correspond to each receiving port.

12. An electronic lock assembly comprising:

an interior assembly including a circuit board and a latch assembly, the circuit board configured to control operation of the latch assembly;

an exterior assembly including the electronic lock assembly, the electronic lock assembly configured to permit a user to control the latch assembly, the exterior assembly further including a first type of electrical wiring and a second type of electrical wiring; and a unitary connector assembly configured to connect both the first type of electrical wiring and the second type of electrical wiring with the interior assembly, the connector assembly comprising:

a first type of connector, the first type of connector including a receiving port to receive the first type of electrical wiring and a transmission port to transmit information received from the first type of electrical wiring;

a second type of connector, the second type of connector including a receiving port to receive the second type of electrical wiring and a transmission port to transmit information received from the second type of electrical wiring; and a shell having at least one cavity, wherein the first type of connector is positioned substantially within the cavity and the second type of connector is positioned substantially within the cavity.

13. The electronic lock assembly of claim 12, wherein the shell of the connector assembly includes a rotatable pull tab to permit the connector assembly to be disconnected from the interior assembly.

14. The electronic lock assembly of claim 12, wherein the connector assembly is positioned within a cavity of the exterior assembly.

15. The electronic lock assembly of claim 12, wherein the transmission port of the first type of connector assembly is received by a first receiving dock of the interior assembly and the transmission port of the second type of connector assembly is received by a second receiving dock of the interior assembly.

16. The electronic lock assembly of claim 15, wherein the first receiving dock and the second receiving dock are coupled to the circuit board.

17. The electronic lock assembly of claim 12, wherein the second type of connector includes two or more receiving ports and two or more transmission ports.

18. The electronic lock assembly of claim 17, wherein the two or more transmission ports are received by a first receiving dock of the interior assembly, the first receiving dock including two or more docking inlets that correspond with each transmission port.

19. A method of forming an electronic lock assembly, the method comprising:

providing an interior assembly including a circuit board and a latch assembly, the circuit board configured to control operation of the latch assembly;

providing an exterior assembly including a first type of electrical wiring and a second type of electrical wiring;

providing a unitary connector assembly, the connector assembly comprising a first type of connector associated with the first type of electrical wiring and a second type of connector associated with the second type of electrical wiring, the first and second types of connectors each including a receiving port to receive the first and second types of electrical wiring, respectively, the first and second types of connectors each including a transmission port to transmit information received from the first and second types of electrical wiring, respectively, and the first type of connector and the second type of connector positioned within at least one cavity of a shell of the unitary connector assembly and extending partially through one or more apertures of the shell, wherein the shell includes a rotating pull tab; and connecting the first type of electrical wiring and the second type of electrical wiring of the exterior assembly with the circuit board of the interior assembly by connecting the unitary connector assembly with an interior connector assembly of the interior assembly.

* * * * *